US006276328B1

(12) United States Patent
Denton et al.

(10) Patent No.: US 6,276,328 B1
(45) Date of Patent: Aug. 21, 2001

(54) DIESEL AIR INTAKE SHUT DOWN DEVICES AND METHODS

(76) Inventors: Daniel Webster Denton, deceased, late of Boling, TX (US); by Jewell Marie Denton, legal representative, P.O. Box 87, Boiling, TX (US) 77420

( * ) Notice: Subject to any disclaimer, the term of this patent is extended or adjusted under 35 U.S.C. 154(b) by 0 days.

(21) Appl. No.: 09/595,562

(22) Filed: Jun. 15, 2000

(51) Int. Cl.[7] ..... F02B 77/00
(52) U.S. Cl. ..... 123/198 D; 60/611
(58) Field of Search ..... 123/198 D; 60/611

(56) References Cited

U.S. PATENT DOCUMENTS

| | | |
|---|---|---|
| 4,029,073 | 6/1977 | Day . |
| 4,092,970 | 6/1978 | Bell et al. . |
| 4,366,790 | 1/1983 | DeBoynton . |
| 4,499,733 | 2/1985 | Farr et al. . |
| 5,003,943 | 4/1991 | Lafferty, Sr. . |
| 5,050,548 | 9/1991 | Minegishi . |
| 5,072,702 | 12/1991 | Sasaki et al. . |
| 5,653,207 | 8/1997 | Denton . |

*Primary Examiner*—Noah P. Kamen
(74) *Attorney, Agent, or Firm*—Michael B. Jolly

(57) ABSTRACT

An air intake shut down device which utilizes variations in the ratio of air pressure and vacuum during load and no load conditions in different locations of a turbo charged engine air intake to influence movement of a pair of diaphragms which are linked to trip a butterfly valve mounted within a diesel engine air intake system. The butterfly valve is mounted between the engine air filter and turbo charger. One diaphragm moves to trip the butterfly valve when exposed to increased vacuum between the turbo charged and engine air filter during no load high engine speeds. The other regulating diaphragm moves to resist tripping the butterfly valve when exposed to increased air pressure between the turbo charger and the engine during load high engine speeds. During no load high engine speeds, vacuum influence on the first diaphragm is increased and counteractive air pressure on the regulating diaphragm is decreased resulting in the a net overall movement which trips the butterfly valve to close. Engine oil pressure and coolant temperature are monitored by sensors which supply truck air pressure to one diaphragm to trip the shut off valve during detrimental conditions. The over speed control component of the system may be deactivated while maintaining the oil and coolant monitoring controls.

16 Claims, 4 Drawing Sheets

DIESEL AIR INTAKE SHUT DOWN DEVICES AND METHODS

TECHNICAL FIELD

The present invention relates to diesel engine air intake shut down devices and methods and more particularly to air intake shut down devices which operate automatically shutting down the air intake of an over revving turbo charged diesel engine and which is actuated by variations in intake air pressure and vacuum. The device is self monitoring, may be bypassed or locked-out for over the road vehicle use, may be operated by any number of vehicle engine conditions such as oil pressure, coolant temperature, and engine speed. The device may be set up fully automatic requiring no electrical power or user input for operation and may also include a manual trip lever.

BACKGROUND ART

Diesel engines are frequently damaged or destroyed by over revving, over heating, or operating with no or low oil pressure. Often diesel engines are operated in remote locations without monitoring by persons, instruments or equipment which would either automatically or manually shut down the engine when a detrimental condition arises. Additionally, diesel engines installed in tractor trailer rigs are frequently damaged or destroyed by operating with no or low oil pressure, in an overheated condition, or over revving. Over revving may occur when a diesel is operated in an atmosphere with high levels of volatile hydrocarbons, which may occur near oil wells, chemical plants, mining, and fuel loading areas. In these areas fugitive volatile hydrocarbons may be drawn into the diesel engine air intake and used as unregulated fuel for the engine which then uncontrollably revs resulting in catastrophic engine failure and possibly explosion. Diesel fuel shut off devices are not effective since the atmosphere is the fuel source via the engine air intake system. Accordingly, air intake shut off devices are employed which are either manually or automatically actuated. With manually operated shut down systems the operator is usually not near the tripping mechanism and the over revving and engine failure usually occurs with such rapidity that manual input is not possible. Automated air intake shut down devices are frequently actuated by electrical components with various sensors for monitoring engine conditions. While these prior art shut down devices which utilize electrical actuators are useful the various electrical components often fail leaving the entire shut down system inoperable. Additionally air intake shut down systems installed on over the road trucks are not able to be deactivated to prevent inadvertent shut down during normal driving conditions. It is also desirable to deactivate the over revving component of the shut down device, for over the road use, while maintaining operation of other shut down parameters, such as oil pressure and water temperature. There is a need for a shut down system to protect a diesel engine from over revving, low oil pressure, high coolant temperature and which may be activated manually, requires no external power supply for operation, and the over revving component may be deactivated or bypassed if desired while retaining the oil pressure and water temperature shut down control. The present invention accomplishes these and other goals by utilizing an air intake shut off valve which is tripped to shut off air flow there through by specific engine parameters including over revving, oil pressure, and coolant temperature. The device utilizes variations in the ratio between the air pressure and vacuum measured in different locations of the air intake of a turbo charged diesel engine during load and no load conditions. During load conditions, such as when the output shaft of the engine is coupled to a load, such as a truck drive train, a pump or some other machinery, a slight vacuum is created between the turbo and air filter, while at the same time between the turbo and the engine, air pressure increases. During no load conditions, such as uncontrolled over revving which occurs when the engine throttle is opened and the engine output is not coupled to a load, vacuum is increased and the amount of air pressure increase is lower. The invention utilizes these disproportionate pressure and vacuum changes to regulate and trip the shut off valve. The device includes a butterfly valve mounted within the engine air intake and between the air cleaner and the turbo charger intake. The valve is moved from an open position to a closed position by a tripping mechanism which is tripped by the movement of a pair of diaphragms which is caused by changes in air pressure and vacuum within the air intake system both upstream and downstream of the turbo charger of the engine. A primary diaphragm moves the tripping mechanism to a closed by the influence of vacuum between the turbo charger and the air filter, while the other diaphragm regulates and counteracts movement of the primary diaphragm by the influence of increased air pressure between the turbo charger and the engine during high revving load conditions. The dual diaphragm system, with one diaphragm regulating the other, assures the shut down device will only operate when the engine is over revving during no load conditions. Other engine parameters are linked to the shut down system by utilizing truck air, created by the onboard truck air pump, which is utilized to influence movement of the diaphragms and valve if oil pressure drops or water temperature increases. The invention includes a system which allows the over revving component of the shut down device to be bypassed or deactivated while maintaining the oil pressure and water temperature controls, which is very useful for over the road truck use. The device may also be retro fitted on DETROIT™ diesel engines equipped with a blower to control closing the flapper valve in the same manner.

GENERAL SUMMARY DISCUSSION OF INVENTION

It is thus an object of the invention to provide a diesel engine air intake shut down device for a turbo charged diesel engine with a valve positioned in the air intake tube of the engine and between the turbo charger and air filter and where the valve includes a tripping mechanism which moves the valve to a closed position blocking the flow of air through the air intake tube, movement of a pair of diaphragms trips the mechanism, where one side of a primary diaphragm is in communication with a vacuum obtained from the air intake tube between the air filter and the turbo charger which provides a force on the primary diaphragm urging the primary diaphragm to move in a tripping direction, and one side of a regulating diaphragm is in communication with air pressure obtained from the air intake tube between the turbo charger and the engine which provides a force on the regulating diaphragm urging the regulating diaphragm to resist movement of the primary diaphragm in the tripping direction, when the force applied to the primary diaphragm exceeds the force applied to the regulating diaphragm the diaphragms move to a tripping direction and the valve closes.

It is a further object of the invention to provide a diesel engine air intake shut down device for installation on turbo charged diesel engines with a butterfly valve positioned in the air intake tube of the engine and which valve includes a tripping mechanism which moves the valve to a closed position blocking the flow of air into the engine's air intake, where the tripping mechanism is self contained, operates on changes in air pressure and vacuum which occurs at different locations of the air intake tube and wherein the tripping mechanism only operates to close the valve when the engine is operating in an over speed condition without a load. In other words the shut down device only operates when the engine over revs and is not coupled, by its drive output, to a loading device, such as a drive train of a truck or tractor, a pump or some other machinery.

It is a still further object of the invention to provide a diesel engine air intake shut down device which is fully automatic does not require any outside power source or electrical components for operation.

It is a still further object of the invention to provide a diesel engine air intake shut down device which is fully automatic in operation and operates by closing the air intake of a over revving no loaded turbo charged diesel engine, and which further may operate to shut down the engine when oil pressure is reduced or if coolant temperature exceeds a given temperature. The invention includes a lockout device which allows the over revving tripping mechanism to be deactivated while the oil pressure and coolant temperature shut down features remain activated, the lockout device may be initiated by a manual switch or an emergency brake switch so that inadvertent shut down does not occur. The lockout feature of the invention allows the shut down system to be installed on over the road trucks and prevents inadvertent operation of the over revving function, such as when a truck driver miss shifts causing the engine to over rev without a load on the engine, or if the engine's throttle is inadvertently or momentarily opened with the truck not in gear or under way.

It is a still further object of the invention to provide a diesel engine air intake shut down device which is mountable to an existing DETROIT diesel engine equipped with a blower and which is connected to the existing flapper valve commonly found on these ubiquitous engines.

Accordingly, a diesel engine air intake shut down device is provided which includes a tripping mechanism which may be attached to either a flapper valve on a DETROIT diesel engine equipped with a blower or to butterfly valve installed in an air intake tube on a regular turbo charged diesel engine, the tripping mechanism is moves the valve to a closed position by the movement of a pair of diaphragms as described herein, movement of the diaphragms to trip the mechanism may be caused by numerous parameters including; over revving a non-loaded engine, low or no oil pressure or high coolant temperature. The tripping mechanism may be locked out or deactivated for either some, one, or all parameters. The lockout allows the shut down device to be installed on over the road trucks that frequent volatile hydrocarbon areas while eliminating the potential of inadvertent operation of the shut down valve.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 3:
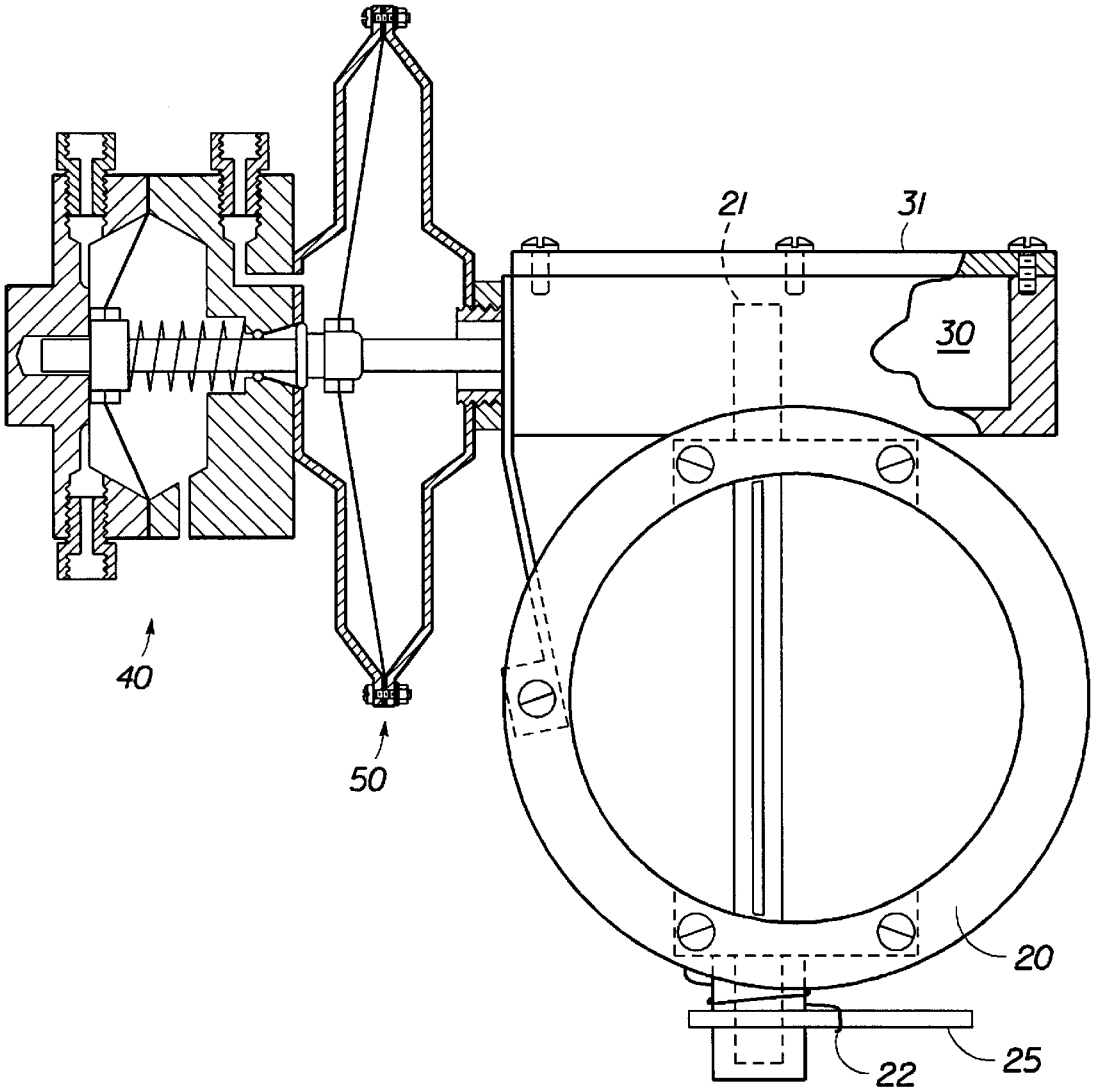
FIG. 3 is a cross section along line A—A of FIG. 2 illustrating the valve tripping mechanism in relation to a butterfly valve.
Figure 4:
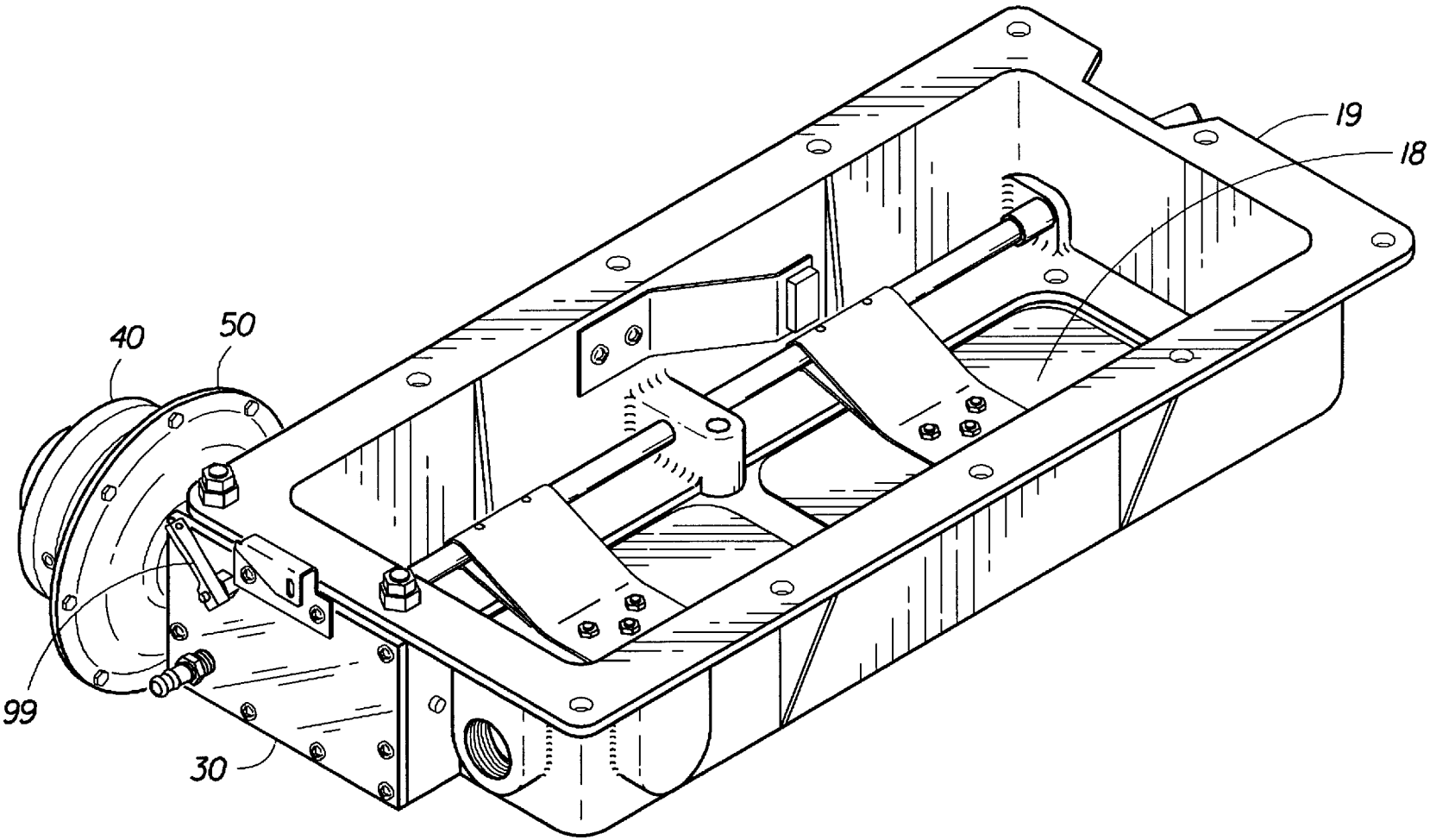
FIG. 4 is a perspective view of the shut down system mounted to a DETROIT™ diesel intake air box.

The air intake shut down device is particularly suitable for installation on turbo charged diesel engines and may also be installed on DETROIT™diesel engines which are equipped a super charger, an air box and a blower as illustrated in FIG. 4. The shut down system includes a valve tripping mechanism 30 mechanically coupled to the shut down valve 20 which is illustrated as a offset butterfly valve in FIG. 3. The tripping mechanism 30 includes a regulating diaphragm 40 and primary diaphragm 50 providing input to trip the mechanism. The diaphragms are exposed to either vacuum or air pressure which displaces them and provides movement which in turn trips the tripping mechanism to close the shut down valve.

Through out this disclosure the term "load" or "no load" conditions refers to an output of a diesel engine either coupled to or not coupled to a load. For example, if a truck transmission is not engaged and the engine throttle opened, this would be considered a "no load" condition, if the truck transmission were engaged and the throttle were opened, this would be considered a "load" condition. "Over revving" means a diesel engine is operating at dangerously high revolutions which could lead to catastrophic engine failure.

The invention takes advantage of changes in pressure and vacuum in different locations of the air intake system of a turbo charged diesel engine and variations in the ratio of pressure and vacuum when the engine operates under a load versus a no load condition. The inventor has found that a vacuum in the air intake tube 11 between the air filter 12 and turbo charger 13 increases when the engine over revs under a no load condition when compared to vacuum measured in the same location when the engine revs under a load condition. Inversely, air pressure measured in the air intake tube 15 between the turbo charger 13 and the intake manifold 14 decreases when the engine over revs under a no load condition when compared to air pressure measured in the same location when the engine revs under a load condition. In this invention, the vacuum is used to displace the primary diaphragm 50 to trip the valve closing mechanism while the air pressure is used to regulate the displacement of the primary diaphragm by counteracting it displacement with a regulating diaphragm 40.

Figure 1:
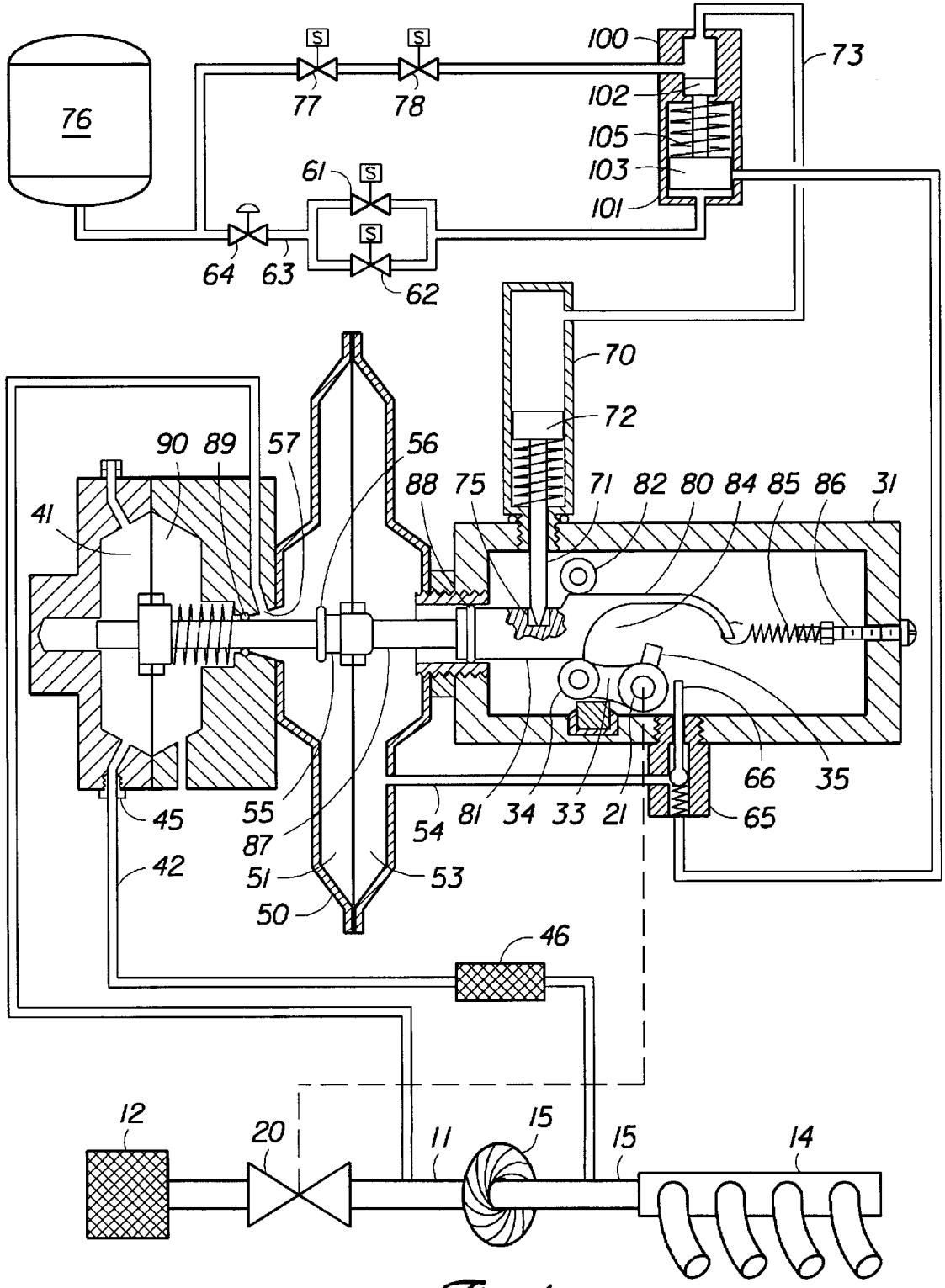
FIG. 1 is a schematic diagram of the shut down system illustrating the valve tripping mechanism, primary diaphragm, regulating diaphragm, shuttle valve and other components with the tripping mechanism in a deactivated valve open position.
Figure 2:
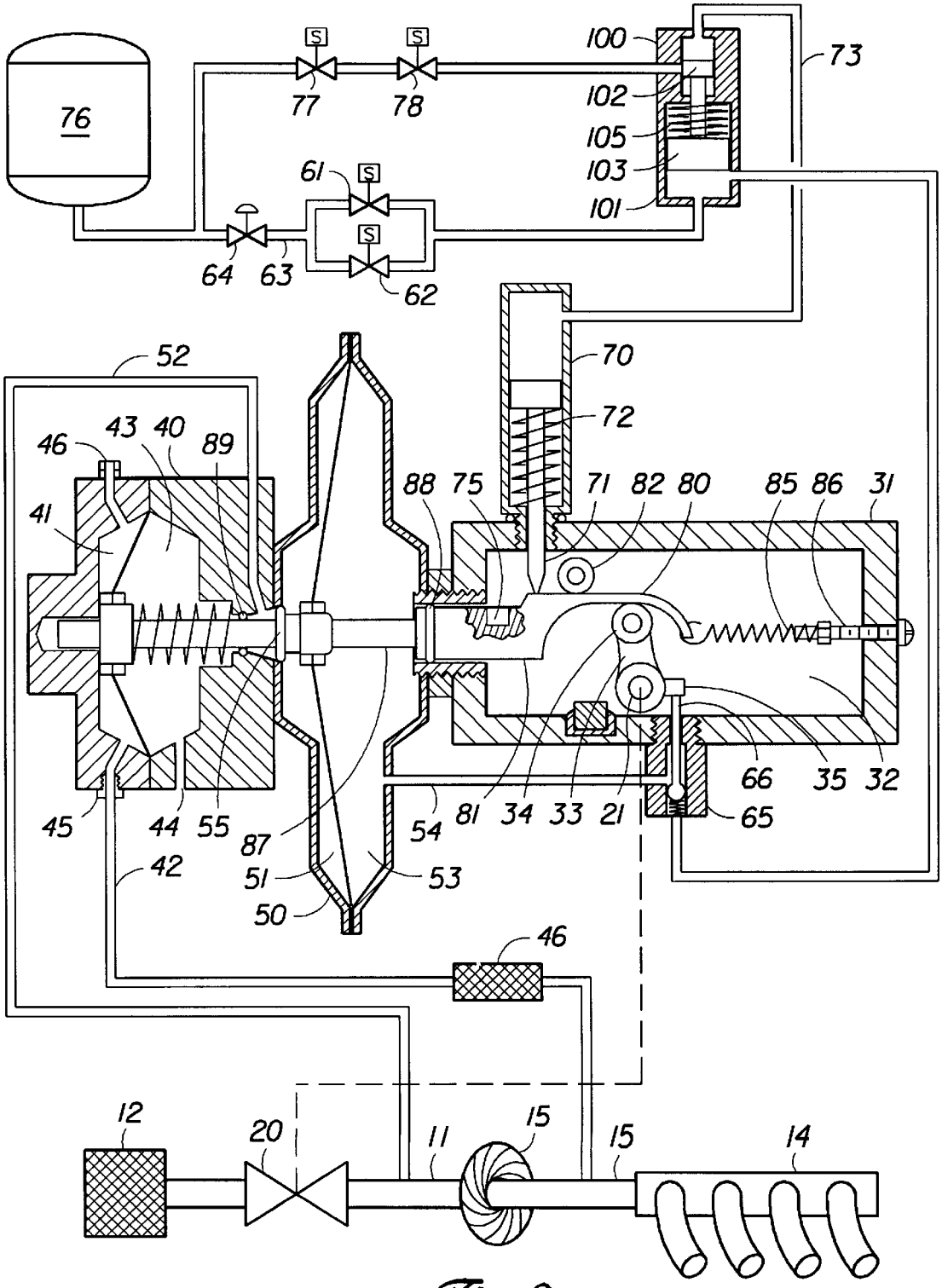
FIG. 2 is a schematic diagram of the shut down system illustrating the valve tripping mechanism, primary diaphragm, regulating diaphragm, shuttle valve and other components with the tripping mechanism in an activated valve closed position.

The shut down valve 20 is preferably dimensioned to easily fit the diameter of the air intake tube so prevent air restriction. The tripping mechanism and diaphragms are attached to a side of the butterfly valve and the FIGS. 1 and 2 are an enlarged and simplified view of the air lines and tripping mechanism for illustrative purposes only while the placement of the specific components of the invention is limited only by space and convenience.

The tripping mechanism 30 includes the housing 31 which is preferably attached adjacent to the shut down valve 20 so that the shut down valve shaft 21 may be easily extended into an interior 32 of the housing 31. An arm 33 is attached to an end of the valve shaft and fixedly secured so that when the shaft rotates the arm moves, the extent of the movement of the arm will be in about a 90 degree arc and should coincide with the movement of the valve plate. The valve shaft includes a spring 22 mounted to an opposing end of the valve shaft as the arm and serves as a biasing means to urge the valve shaft to rotate and remain in a closed position, blocking the flow of air through the shut down valve. The spring assures that when the tripping mechanism 30 releases the arm 33, the valve shaft will positively rotate to a closed position, in addition to the influence of air traveling through the air intake tube to urge the valve plate to a closed position.

The arm 33 includes a roller end 34 which contacts a linearly moving notched plunger 80. The roller end 34 reduces friction and provides smooth operation of the triggering mechanism. The notched plunger 80 includes plateau 81 which provides a location for supporting the roller end 34 of the arm when the valve shaft is in the open position as illustrated in FIG. 1 and when the notched plunger is linearly moved so that the plateau 81 is in alignment with the roller end 34 of the arm. The notched plunger 80 is guided and supported by a steel roller 82 which about opposes the contact area of the roller end 34 of the arm when the valve shaft is in the open position. The steel roller is attached to the tripping mechanism housing and provides a friction reduced support for the plunger so that it may freely move linearly within the interior of the housing. The plunger includes a notched area 84 which accommodates the roller end 34 of the arm when the plunger is linearly moved to align the notch with the roller end 34 and when the valve shaft rotates to a valve closed position, as illustrated in FIG. 2. A return spring 85 is attached to an end of the plunger 80 to assure the plunger moves linearly to the valve open position, as illustrated in FIG. 1, when the valve shaft is manually rotated, by use of manual lever 25, so that the roller end 34 of the arm may rest upon the plateau 81. The tension of return spring 85 is adjustable by screw 86 to assure an appropriate amount of spring force is applied to return the plunger to a valve open position without affecting the tension and operation of the primary and regulating diaphragms.

The primary diaphragm 50 includes a vacuum side 51 exposed to a vacuum from air intake tube 11 via tubing 52 and a pressure side 53 exposed to air pressure from truck auxiliary air via tube 54. Regulating diaphragm 40 includes a pressure side 41 exposed to air pressure from air intake tube 15 via tubing 42 and an ambient side 43 exposed to ambient air conditions via vent 44. A diaphragm plunger 87 extends through and connects both diaphragms and is connected to the notched plunger 80 in the housing 31. The diaphragm plunger 87 moves linearly in or out of the diaphragms and is sealed by O-rings 88 and 89 to prevent leakage between the diaphragms and the housing. The primary diaphragm 50 includes a built in vacuum inlet check valve 55 which blocks the flow of vacuum in the vacuum side 51 of the primary diaphragm when the diaphragm has moved to a valve closed position as in FIG. 2, thus preventing increased vacuum, which occurs during air intake shut down, from damaging the primary diaphragm. The check valve 55 includes an O-ring 56 which moves linearly with the diaphragm plunger and blocks the vacuum inlet 57 when the plunger has moved to a valve closed position. The regulating diaphragm 40 provides a force, as a result of its pressure side 41 being exposed to air pressure, in opposition to a force applied to the primary diaphragm by the vacuum. The dimensions of both diaphragms are dependant on the diesel engine to which the shut down device will be installed, normally, the regulating diaphragm will be somewhat smaller than the primary diaphragm, additionally multiple diaphragms may be used to provide an appropriate force to trip the mechanism. Air pressure supply to the regulating diaphragm 40 may also be restricted by an orifice 45 and a bleed orifice 46. Air supply to the regulating diaphragm 40 via tube 42 includes a cooler 46 which may also include an internal air filter to prevent the intrusion of soot and other debris into the orifice 45 and the diaphragm 40 while also protecting the diaphragm from excessive heat.

The shut down device may also be provided with a lockout device which includes an air cylinder 70 mounted to the housing 31 wherein the air cylinder 70 includes an extending rod 71 attached to piston 72 and a spring position to retract the rod 71 within the air cylinder 70 while a rod receiving aperture 75 is located on the notched plunger and the mounting of the air cylinder on the housing 31 and the location of the aperture 75 allow the extending rod 71 to align with the aperture 75 when the notched plunger 80 is in a valve open position, this allows the plunger linear movement to be incapacitated only when the valve is open. Auxiliary truck air pressure is supplied to the air cylinder 70 via tubing 73. The truck air pressure is supplied via a truck air reservoir 76 which usually is supplied at about 100psi. The air supply may be controlled by an emergency brake air valve switch 77 or a manual air valve switch 78, or both. The emergency brake switch 77 would preferably by arranged so that when the emergency brake is set, such as when a truck driver parks at a fuel loading dock, air pressure is released from the air cylinder and the extending rod retracts from the aperture 75 into the air cylinder and thus allows the plunger 80 to linearly move to trip the valve to a close position, if necessary. Conversely, when the truck is under way, the emergency brake is released, air pressure is then supplied to the air cylinder locking out the tripping function of the device, thereby assuring the device will not inadvertently trip while in normal operation.

The device may also be equipped with a oil pressure and coolant temperature shut down function. This includes auxiliary truck air from reservoir 76 supplied to oil pressure air valve switch 61, water temperature air valve switch 62 which are plumbed in parallel with air lines 63, a regulator 64 controls the truck air pressure supplied to this component of the device. Auxiliary truck air pressure is supplied to the pressure side 53 of the primary diaphragm 50 when the oil pressure air valve switch 61 opens or when the coolant temperature air valve switch 62 opens via air line 54. A cut off valve 65 is positioned on the air line 54 to prevent air pressure from continually providing force on the pressure side 53 of the primary diaphragm when the valve has moved to a closed position. The cut off valve 65 is mounted to the housing 31 and includes a plunger 66 which block air flow there through when contacted by cog 35 which extends from arm 33 and contacts the plunger 66 only when the arm 33 has move to a valve close position as in FIG. 2. Another feature of the invention, allows the lockout air cylinder 70 to be activated as in FIG. 1, while concurrently maintaining oil pressure and coolant temperature shut down capabilities. This is accomplished by a pair of shuttle valves, one lockout shuttle valve 100 mechanically coupled to a coolant/oil shuttle valve 101. The lockout shuttle valve 100 includes a piston 102 which moves from a position blocking the flow of auxiliary air to the air cylinder, as illustrated in FIG. 2, thereby incapacitating the lock out cylinder and allowing the tripping mechanism to function, to a position where the piston 102 allows the flow of auxiliary air to the air cylinder allowing the air cylinder to lockout the function of the tripping mechanism. The coolant/oil shuttle includes a piston 103 which moves from a position blocking the flow of auxiliary air from the coolant and/or oil valve switches 61,62 to the pressure side 53 of the primary diaphragm, as illustrated in FIG. 1, to a position allowing the flow of auxiliary air to the pressure side 53 of the primary diaphragm. A spring 105 urges the piston 103 to a position blocking auxiliary air flow, and when one valve either the coolant temperature or the oil pressure open, auxiliary air pressure moves the piston 103 thereby opening the flow of air pressure to the pressure side 53 of the primary diaphragm while concurrently, since the pistons are mechanically coupled, moving piston 102 to position blocking the flow of air to the lockout cylinder thereby releasing the lockout of the tripping mechanism.

The tripping mechanism as described may be adapted to numerous other valves other than the butterfly valve including a DETROIT™ diesel engine with an air box 18 and flapper valve plate 19, as illustrated in FIG. 4, which are utilized and are already positioned between the engine's blower and the air cleaner. The system may also include a manual tripping arm 99 capable of being activated by cable.

It is noted that the embodiment of the diesel air intake shut down device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A diesel engine air intake shut down device installed on a turbo charged diesel engine wherein the diesel engine includes an air intake tube extending between an air filter and the turbo charger and an air intake tube extending between the turbo charger and the engine, the device comprises:

a) an offset butterfly valve installed within the air intake tube between the air filter and the turbo charger, the valve includes an offset valve plate and a valve shaft orientated so that air flowing through the air intake tube and the valve into the engine urges the valve plate and shaft to rotate from an open position allowing the flow of air there through to a closed position blocking the flow of air there through, the valve includes a spring attached to a valve shaft end which urges the valve shaft to rotate from the open to the closed position, b) a valve tripping mechanism mechanically coupled to a valve shaft end which controls rotation of the valve shaft and plate from an open to a closed position, the valve tripping mechanism includes a pair of diaphragms which move the tripping mechanism from a valve open position to a valve closed position, the diaphragms comprise a primary diaphragm and a regulating diaphragm, the primary diaphragm is mechanically coupled to the tripping mechanism and has one side in communication with vacuum from the air intake tube between the air filter and the turbo charger, the vacuum exerts a force on the primary diaphragm and urges the primary diaphragm to move the tripping mechanism from a valve open position to a valve closed position, the regulating diaphragm is mechanically coupled to the primary diaphragm and has one side in communication with air pressure from the air intake tube between the turbo charger and engine, the air pressure exerts a force on the regulating diaphragm which urges the regulating diaphragm to resist the movement of the primary diaphragm to move the tripping mechanism from a valve open position to a valve closed position, the primary diaphragm moves the tripping mechanism to a valve closed position when the force of the vacuum on the primary diaphragm exceeds the air pressure force on the regulating diaphragm.

2. The diesel engine air intake shut down device of claim 1 wherein the tripping mechanism further comprises a lock out device which prevents the movement of the tripping mechanism from a valve open position to a valve closed position.

3. The diesel engine air intake shut down device of claim 2 for installation on trucks or machinery with an auxiliary air supply further comprising a coolant temperature shut down system and a low oil pressure shut down system which comprises a high temperature coolant air valve switch, a low oil pressure air valve switch, an auxiliary air supply line attached to each air valve switch, an air passageway extending from each air valve switch to a side opposing the vacuum side of the primary diaphragm, a cutoff valve positioned between each air valve switch and the primary diaphragm which blocks air flow to the primary diaphragm when the valve tripping mechanism has moved to a valve closed position, the lockout device further comprises an air cylinder with an extending rod that blocks the movement of the valve tripping mechanism from a valve open position to a valve closed position when auxiliary air is supplied to the air cylinder, and where the air cylinder extending rod retracts to allow the movement of the valve tripping mechanism from a valve open position to a valve closed position when auxiliary air is not supplied to the air cylinder, a lockout shuttle valve positioned on the auxiliary air supply line to the lock out cylinder, a coolant/oil shuttle valve installed on the air passageway between each air valve switch and the cutoff switch, the coolant/oil shuttle valve includes a piston which moves from a position blocking the flow of auxiliary air to the cutoff valve when no auxiliary air pressure is applied to a position allowing the flow of auxiliary air to the cutoff valve when auxiliary air pressure is applied while simultaneously moving a lockout shuttle valve piston from a position allowing the flow of auxiliary air to the air cylinder when the coolant/oil shuttle piston is in the position blocking the flow of auxiliary air to a position blocking the flow of auxiliary air to the air cylinder when the coolant/oil shuttle piston is in the position allowing the flow of auxiliary air to the cutoff valve, a mechanical connection between the lockout shuttle and coolant/oil shuttle valve pistons.

4. The diesel engine air intake shut down device of claim 1 wherein the primary diaphragm further comprise a plurality of primary diaphragms each with a common side in communication with a vacuum obtained from the air intake tube between the air filter and the turbo charger where the vacuum exerts a force on each primary diaphragm which cumulatively urges the tripping mechanism to move from a valve open position to a valve closed position.

5. The diesel engine air intake shut down device of claim 4 where the plurality of primary diaphragms further comprise a number of primary diaphragms necessary to obtain an adequate force which exceeds the air pressure force exerted on the regulating diaphragm, when the diesel engine is operating at excessive speeds and an engine output shaft is not coupled to a load.

6. The diesel engine air intake shut down device of claim 1 where the tripping mechanism further comprises a tripping mechanism housing attached to a side of the butterfly valve, a valve shaft end extending into an interior of the housing, an arm attached to the valve shaft end, a plunger mechanically coupled to the primary diaphragm and mounted for linear movement within the tripping mechanism housing wherein the plunger linearly moves from a position preventing rotation of the valve shaft by contacting the valve shaft arm corresponding to the valve open position to a position allowing rotation of the valve shaft by allowing movement of the valve shaft arm corresponding to the valve closed position.

7. The diesel engine air intake shut down device of claim 1 for installation on trucks or machinery with an auxiliary air supply further comprising a low oil pressure shut down system which comprises a low oil pressure air valve switch, an auxiliary air supply line attached to the air valve switch, an air passageway extending from the air valve switch to a side opposing the vacuum side of the primary diaphragm, a cutoff valve positioned between the oil pressure air valve switch and the primary diaphragm which blocks air flow to the primary diaphragm when the valve tripping mechanism has moved to a valve closed position.

8. The diesel engine air intake shut down device of claim 1 for installation on trucks or machinery with an auxiliary air supply further comprising a coolant temperature shut down system which comprises a high temperature coolant air valve switch, an auxiliary air supply line attached to the air valve switch, an air passageway extending from the air valve switch to a side opposing the vacuum side of the primary diaphragm, a cutoff valve positioned between the high temperature coolant air valve switch and the primary diaphragm which blocks air flow to the primary diaphragm when the valve tripping mechanism has moved to a valve closed position.

9. A diesel engine air intake shut down device retrofitted on a air box of a super charged diesel engine wherein the diesel engine includes an air inlet tube extending from the air cleaner and the air box, and where the air box includes a flapper valve installed therein, and wherein a blower is mounted between the air box and the engine air intake, the device comprises:

a) a flapper valve shaft extending from the air box b) a valve tripping mechanism mechanically coupled to a valve shaft end which controls rotation of the valve shaft and plate from an open to a closed position, the valve tripping mechanism includes a pair of diaphragms which move the tripping mechanism from a valve open position to a valve closed position, the diaphragms comprise a primary diaphragm and a regulating diaphragm, the primary diaphragm is mechanically coupled to the tripping mechanism and has one side in communication with vacuum from the air intake tube between the air filter and the air box, the vacuum exerts a force on the primary diaphragm and urges the primary diaphragm to move the tripping mechanism from a valve open position to a valve closed position, the regulating diaphragm is mechanically coupled to the primary diaphragm and has one side in communication with air pressure from the blower, the air pressure exerts a force on the regulating diaphragm which urges the regulating diaphragm to resist the movement of the primary diaphragm to move the tripping mechanism from a valve open position to a valve closed position, the primary diaphragm moves the tripping mechanism to a valve closed position when the force of the vacuum on the primary diaphragm exceeds the air pressure force on the regulating diaphragm.

10. The diesel engine air intake shut down device of claim 9 wherein the tripping mechanism further comprises a lock out device which prevents the movement of the tripping mechanism from a valve open position to a valve closed position.

11. The diesel engine air intake shut down device of claim 10 for installation on trucks or machinery with an auxiliary air supply further comprising a coolant temperature shut down system and a low oil pressure shut down system which comprises a high temperature coolant air valve switch, a low oil pressure air valve switch, an auxiliary air supply line attached to each air valve switch, an air passageway extending from each air valve switch to a side opposing the vacuum side of the primary diaphragm, a cutoff valve positioned between each air valve switch and the primary diaphragm which blocks air flow to the primary diaphragm when the valve tripping mechanism has moved to a valve closed position, the lockout device further comprises an air cylinder with an extending rod that blocks the movement of the valve tripping mechanism from a valve open position to a valve closed position when auxiliary air is supplied to the air cylinder, and where the air cylinder extending rod retracts to allow the movement of the valve tripping mechanism from a valve open position to a valve closed position when auxiliary air is not supplied to the air cylinder, a lockout shuttle valve positioned on the auxiliary air supply line to the lockout cylinder, a coolant/oil shuttle valve installed on the air passageway between each air valve switch and the cutoff switch, the coolant/oil shuttle valve includes a piston which moves from a position blocking the flow of auxiliary air to the cutoff valve when no auxiliary air pressure is applied to a position allowing the flow of auxiliary air to the cutoff valve when auxiliary air pressure is applied while simultaneously moving a lockout shuttle valve piston from a position allowing the flow of auxiliary air to the air cylinder when the coolant/oil shuttle piston is in the position blocking the flow of auxiliary air to a position blocking the flow of auxiliary air to the air cylinder when the coolant/oil shuttle piston is in the position allowing the flow of auxiliary air to the cutoff valve, a mechanical connection between the lockout shuttle and coolant/oil shuttle valve pistons.

12. The diesel engine air intake shut down device of claim 9 wherein the primary diaphragm further comprise a plurality of primary diaphragms each with a common side in communication with a vacuum obtained from the air intake tube between the air filter and the air box where the vacuum exerts a force on each primary diaphragm which cumulatively urges the tripping mechanism to move from a valve open position to a valve closed position.

13. The diesel engine air intake shut down device of claim 12 where the plurality of primary diaphragms further comprise a number of primary diaphragms necessary to obtain an adequate force which exceeds the air pressure force exerted on the regulating diaphragm, when the diesel engine is operating at excessive speeds and an engine output shaft is not coupled to a load.

14. The diesel engine air intake shut down device of claim 9 where the tripping mechanism further comprises a tripping mechanism housing attached to a side of the air box, a valve shaft end extending into an interior of the housing, an arm attached to the valve shaft end, a plunger mechanically coupled to the primary diaphragm and mounted for linear movement within the tripping mechanism housing wherein the plunger linearly moves from a position preventing rotation of the valve shaft by contacting the valve shaft arm corresponding to the valve open position to a position allowing rotation of the valve shaft by allowing movement of the valve shaft arm corresponding to the valve closed position.

15. The diesel engine air intake shut down device of claim 9 for installation on trucks or machinery with an auxiliary air supply further comprising a low oil pressure shut down system which comprises a low oil pressure air valve switch, an auxiliary air supply line attached to the air valve switch, an air passageway extending from the air valve switch to a side opposing the vacuum side of the primary diaphragm, a cutoff valve positioned between the oil pressure air valve switch and the primary diaphragm which blocks air flow to the primary diaphragm when the valve tripping mechanism has moved to a valve closed position.

16. The diesel engine air intake shut down device of claim 9 for installation on trucks or machinery with an auxiliary air supply further comprising a coolant temperature shut down system which comprises a high temperature coolant air valve switch, an auxiliary air supply line attached to the air valve switch, an air passageway extending from the air valve switch to a side opposing the vacuum side of the primary diaphragm, a cutoff valve positioned between the high temperature coolant air valve switch and the primary diaphragm which blocks air flow to the primary diaphragm when the valve tripping mechanism has moved to a valve closed position.

* * * * *